United States Patent [19]

Comerford

[11] 4,379,955

[45] Apr. 12, 1983

[54] SEALED ROTARY SWITCH

[75] Inventor: John Comerford, Glendale Heights, Ill.

[73] Assignee: Oak Industries, Inc., Rancho Bernardo, Calif.

[21] Appl. No.: 353,831

[22] Filed: Mar. 1, 1982

[51] Int. Cl.[3] ..... H01H 19/64

[52] U.S. Cl. ..... 200/11 DA; 200/291; 200/302

[58] Field of Search ..... 200/11 R, 11 A, 11 B, 200/11 C, 11 D, 11 DA, 11 E, 11 EA, 11 G, 11 H, 11 J, 11 K, 11 TC, 11 TW, 164 R, 291, 292, 302, 307

[56] References Cited

U.S. PATENT DOCUMENTS 3,736,390 5/1973 Lockard ..... 200/11 GX

*Primary Examiner*—A. T. Grimley
*Assistant Examiner*—Morris Ginsburg
*Attorney, Agent, or Firm*—Kinzer, Plyer, Dorn & McEachran

[57] ABSTRACT

A sealed rotary switch has electrical contacts insert-molded in a stator. The stator has generally open ends which are closed by a pair of covers. The joint between the covers and the stator includes a notch filled with adhesive sealant. The covers have aligned openings in which a rotor is mounted for rotation. Each cover has a seat formed around its opening, with a resilient seal member located in the seat and sealing against the rotor.

8 Claims, 7 Drawing Figures

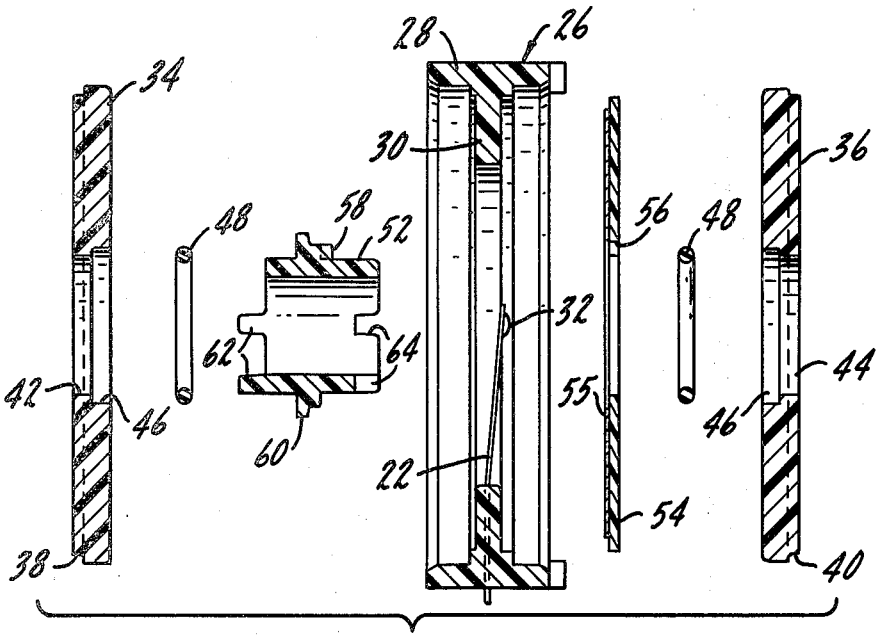
Fig. 4.
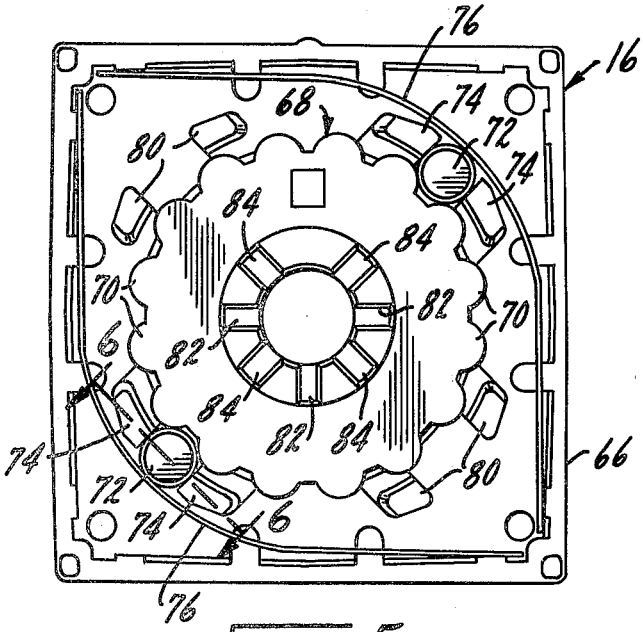
Fig. 5.
Fig. 6.
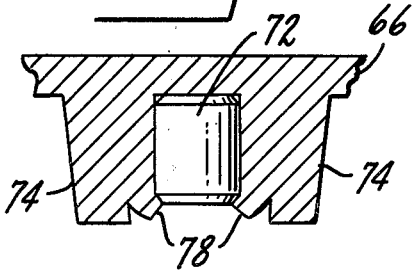
Fig. 7.
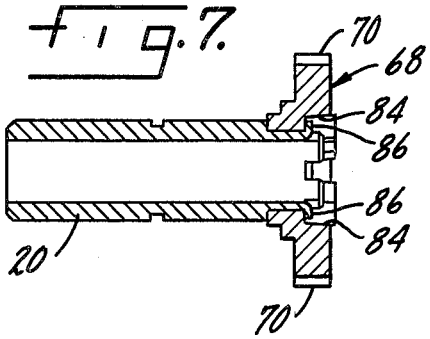

SEALED ROTARY SWITCH

SUMMARY OF THE INVENTION

This invention relates to rotary switches and is particularly concerned with such a switch having a sealed interior.

A primary object of the invention is a sealed rotary switch which can withstand adverse environmental conditions created by manufacturing processes such as wave soldering.

Another object is a sealed rotary switch which can be used in conjunction with a positioning mechanism which locates and holds the rotary switch in a selected position.

Another object is a sealed rotary switch which is adapted for forming compound switch assemblies.

Another object is a sealed rotary switch adapted for use in compound switch assemblies having two separate positioning mechanisms.

Another object is a sealed rotary switch having a dynamic shaft seal at the rotor.

Another objects will appear from time to time in the following specification, drawings and claims.

BRIEF DESCRIPTION OF THE DRAWINGS

FIG. 4 is an exploded view showing the component parts of the sealed rotary switch.

FIG. 5 is a view on an enlarged scale taken substantially along line 5—5 of FIG. 1.

FIG. 6 is a section taken substantially along line 6—6 of FIG. 5.

FIG. 7 is a section of a detent wheel connected to an operating shaft.

DESCRIPTION OF A PREFERRED EMBODIMENT

This invention relates to rotary switches of the type having a sealed interior. Incorporation of rotary switches into electrical systems may require the use of manufacturing processes which would damage an unsealed switch. For example, wave soldering techniques are now being used to connect the leads of a rotary switch to a circuit board. After a wave soldering operation a cleaning step is necessary to remove excess flux and the like. Either the soldering or the cleaning step is capable of damaging the contacts of an unsealed switch. Consequently, it is necessary to provide a switch having a sealed interior which protects the internal contacts from the harmful effects of the environment likely to be encountered by the switch.

Figure 1:
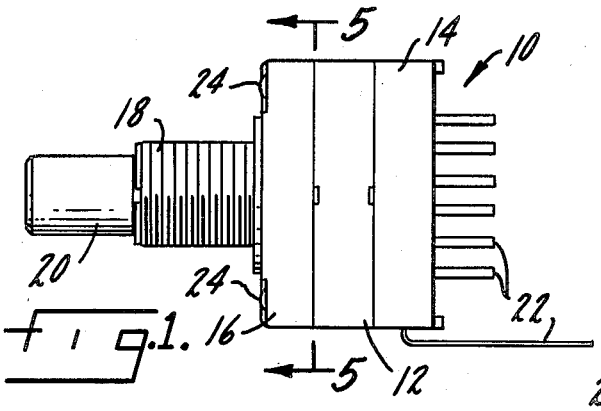
FIG. 1 is a side elevation view of a compound switch assembly using the sealed rotary switch sections of the present invention.

FIG. 1 shows a compound rotary switch assembly 10. The assembly comprises first and second switching sections 12 and 14 which are operated by a positioning mechanism or detent section 16. The detent section may include a bushing 18 which can be used to mount the assembly on a panel. An operating shaft 20 extends through the bushing 18 into the detent section 16 to control the position of the rotary switch sections 12 and 14. The first and second switch sections have a plurality of electrical leads extending therefrom, as shown at 22.

Figure 2:
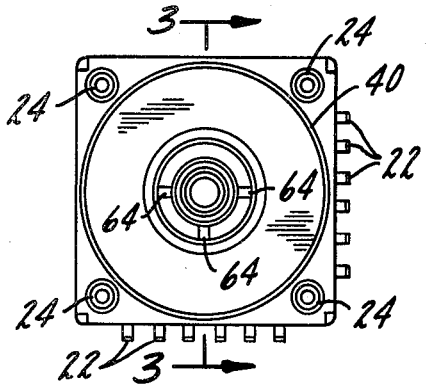
FIG. 2 is an end elevation view of the switch of FIG. 1.

The switch sections and detent section are held together by eyelets 24 (FIG. 2) which extend through holes at the corners of the housings.

Figure 3:
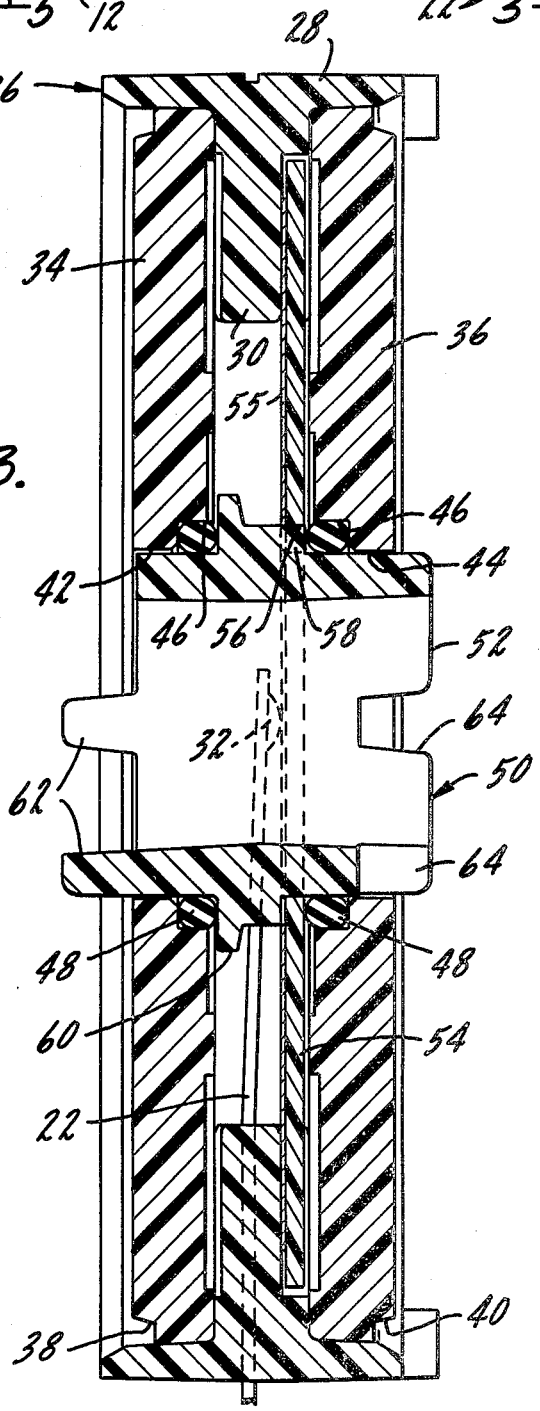
FIG. 3 is an enlarged section taken substantially along line 3—3 of FIG. 2.

FIG. 3 and 4 show the details of a switching section. The switching section includes a stator 26 having side walls 28 and a central ledge 30. The ends of the stator 26 are generally open as best seen in FIG. 4. The electrical leads 22 are insert-molded into the stator. The leads preferably extend through the ledge 30 of the stator and form contacting wipers 32 in the interior of the stator.

The ends of the stator are closed by first and second covers 34 and 36. The covers fits within the side walls 28 of the stator, abutting against the side walls and the ledge 30. The first cover 34 has a notch 38 and the second cover 36 has a notch 40, both notches being formed on the exterior surfaces of the covers. In cooperation with the side walls 28 of the stator, the grooves 38 and 40 form channels at the joints between the covers and stator. These channels are filled with an adhesive sealant to seal the joint between the covers and the stator and fix the covers in place. An acceptable sealant is cyanoacrylate.

The first and second covers have aligned openings 42 and 44 respectively. Each opening has an enlarged portion which forms a seat 46 for a resilient seal member 48.

A rotor 50 includes a hub portion 52 and a printed circuit board 54. The printed circuit board 54 is placed over the rotor hub with a notch 56 on the circuit board mating with a protrusion 58 on the hub so the hub and circuit board rotate together. The hub also has a shoulder 60. The rotor 50 is mounted for rotation in the openings 42 and 44 of the first and second covers. As shown in FIG. 3 the rotor is held in place by the shoulder 60 engaging the seal member 48 of the first cover 34 and the circuit board 54 engaging the seal member 48 of the second cover 36. The seats 46 of the covers hold the seal members 48 in radial compression against the rotor hub 52. This provides a dynamic shaft seal at the rotor and completes the seal between the rotor and the covers.

The circuit board 54 has a pattern of electrical conductors 55 formed on its surface. The conductors are typically arranged in arcuate bands. The contacting wipers 32 are in contact with these bands. Rotation of the circuit board with the rotor hub creates the electrical switching action among the various contacting wipers 32.

It can be seen that in order to provide a compound switch assembly the rotor of a first switching section must engage that of an adjacent switching section. For this purpose each rotor has three legs 62 (FIGS. 3 and 4) extending from one side thereof and correspondingly arranged slots 64 formed on the other side of the hub. When the switching sections are compounded the legs 62 of one rotary switch fit into the slots 64 of the adjacent switch. Thus the rotor hubs are interlocked to form, in effect, a continuous single rotor.

The detent section 16 shown in FIG. 5 can be used to define discrete index positions of the switching section. The detent section includes a detent housing 66 which encloses a detent wheel 68. The housing and wheel may be made of cast metal such as zinc. The detent wheel 68 includes a plurality of protrusions 70 which define grooves between them. The grooves are engagable with a detent roller 72. The roller is flexibly retained by the wheel 68, a pair of shoulders 74 and a detent spring 76. The shoulders 74 may be staked as shown in FIG. 6 at 78 to retain the roller 72. Depending on the shape of the protrusions 70 on the detent wheel, it may be preferable to replace the detent roller with a detent ball. The detent ball is held in place by shoulders 80 which are similar to the shoulders 74 and are located in the opposite corners from shoulders 74. A spring 76 is used to hold the detent roller in engagement with the detent wheel. It is contemplated that either two detent rollers in opposite corners or two similarly arranged detent balls would be used with a particular detent wheel but the balls and rollers would not be used at the same time.

The center of the detent wheel 68 has three slots 82 which are similar to the slots 64 formed in the rotor hub. The slots 82 receive the legs 62 of a rotor in an adjacent switching section, thereby connecting the detent wheel to the rotor.

The center portion of the detent wheel 68 also has four pockets 84. These are connecting points for attaching the operating shaft to the detent wheel 68. An end portion of the shaft is rolled or cold formed into the pockets 84 as shown at 86 in FIG. 7. When the shaft is rotated by an operator, a protrusion 70 forces the detent roller (or ball) away from the detent wheel and out of engagement with a groove. When the next groove on the wheel moves to a location opposite the detent roller, the spring 76 causes the roller to snap back into position between the successive pair of protrusions. Thus, a detent wheel can provide as many index positions as there are grooves on the wheel. A set of stops may also be employed in the detent section to limit the amount of rotation.

The switch of the present invention could be used in a compound switch assembly having more than one positioning mechanism or detent section. For example such a switch might have a first detent section followed by a first switching section and then a second detent section with its own rotary switch. The two detent sections would be operated by concentric shafts with an inner shaft disposed within a hollow outer shaft. Both shafts would extend to a point on the exterior of the compound switch where they could be manipulated by an operator.

The embodiment of the invention in which an exclusive property or privilege is claimed are defined as follows:

1. A sealed rotary switch, comprising:

a stator having side walls with generally open ends;

first and second covers having aligned openings, one cover being located near each end of the stator and in contact with the side walls, the joints between the covers and the side walls including a notch filled with adhesive sealant;

a rotor including a hub and a printed circuit board connected to the hub, the rotor being mounted for rotation in the cover openings with the printed circuit board located between the covers, the covers each having a seat formed around the opening, resilient seal members being disposed in the seats to seal against the rotor hub; and electrical leads insert-molded in the stator and extending into contact with the printed circuit board in the sealed interior of the stator.

2. The switch of claim 1 further comprising a detent section having a housing engageable with the stator, a flexible detent mechanism in the housing, a detent wheel mounted for rotation in the housing, the wheel being connected to the rotor, and a rotatable shaft connected to the detent wheel, the detent wheel having a plurality of grooves engageable with the detent mechanism to define a plurality of index positions of the wheel.

3. The switch of claim 1 or 2 wherein the switch is adapted for forming compound switch assemblies having multiple switches placed adjacent one another, with the stators mating and the rotor hubs interlocking to form a continuous rotor hub.

4. The switch of claim 1 wherein the seats in the covers hold the seal members in radial compression about the rotor hub.

5. The switch of claim 1 wherein the notches at the joint between the covers and sidewalls are formed on the exterior periphery of the covers.

6. The switch of claim 3 wherein the rotor hub includes at least one leg extending from one end and a correspondingly located slot formed in the opposite end for interlocking the hubs of adjacent switch sections.

7. The switch of claim 2 wherein the flexible detent mechanism includes at least one detent roller held in place by a detent spring.

8. The switch of claim 2 wherein said rotor hub includes at least one leg extending from one end and the detent wheel has a slot formed so as to receive the leg of an adjacent switch section, thereby connecting the detent wheel and the rotor.

* * * * *